US006475431B1

(12) United States Patent
Naraghi et al.

(10) Patent No.: US 6,475,431 B1
(45) Date of Patent: Nov. 5, 2002

(54) CORROSION INHIBITORS WITH LOW ENVIRONMENTAL TOXICITY

(75) Inventors: Ali Naraghi, Missouri, TX (US); Nihal U. Obeyesekere, Houston, TX (US)

(73) Assignee: Champion Technologies, Inc., Houston, TX (US)

( * ) Notice: Subject to any disclaimer, the term of this patent is extended or adjusted under 35 U.S.C. 154(b) by 0 days.

(21) Appl. No.: 09/288,893

(22) Filed: Apr. 9, 1999

(51) Int. Cl.[7] ..... C23F 11/04; C23F 11/14

(52) U.S. Cl. ..... 422/12; 422/16; 422/17; 507/243; 507/939; 252/394

(58) Field of Search ..... 422/16, 12, 17; 507/243, 244, 939; 208/47; 252/394, 396; 540/450, 471; 560/171; 562/553, 571

(56) References Cited

U.S. PATENT DOCUMENTS 5,300,235 A * 4/1994 Clewlow et al. ..... 422/16 X

FOREIGN PATENT DOCUMENTS

DE 19524265 A1 * 1/1997

WO WO-9524377 A1 * 9/1995

OTHER PUBLICATIONS

Zucchi, F. et al. Abstract of "Inhibition of pitting corrosion of AISI 304 by organic compounds," Werkst. Korros. (1987), 38(12), pp. 742–745.*

* cited by examiner

*Primary Examiner*—Elizabeth McKane
(74) *Attorney, Agent, or Firm*—Browning Bushman, P.C.

(57) ABSTRACT

A low toxic, biodegradable, water soluble and dispersant series of corrosion inhibitors are described. The method of inhibiting corrosion in aqueous medium by incorporating the inhibitor in PPM is provided. The corrosion inhibitor compromises an acrylic acid and chloroacetic acid adduct of 2-substituted imidazolines or primary, secondary or tertiary amines with carbon chain of twelve to twenty-two saturated or unsaturated carbon atoms. The molar ratio of acrylic acid to chloroacetic acid was methodically changed while keeping the concentration of imidazoline or the amine a constant. The product is made water soluble by raising the pH to 8–9 at the end of the synthesis by adding aqueous sodium hydroxide.

24 Claims, No Drawings

CORROSION INHIBITORS WITH LOW ENVIRONMENTAL TOXICITY

BACKGROUND OF THE DISCLOSURE

The present invention relates generally to the protection of metallic surfaces from corrosion. The invention addresses prevention of corrosion of metallic surfaces with environmentally less damaging inhibitors.

It is a known fact that many oil and gas producing formations yield hydrocarbon, brine, carbon dioxide and/or hydrogen sulfide, which are very corrosive on metal tubing, pumps, casing and other production equipment. This is especially true of metal surfaces, which are exposed to aqueous solutions along with other corrosive chemicals. Corrosion is higher in wells producing brine containing a high percentage of dissolved acidic gases such as carbon dioxide or hydrogen sulfide and inorganic salts, or low molecular weight organic acids such as acetic formic or propionic acid. These chemical ingredients dissolved in water at elevated temperature increases the corrosivity of the medium.

Traditionally, the most common way to reduce corrosion is to add a corrosion inhibitor to a corrosive system to preserve metals. Inhibitors of the corrosion metals are chemical compounds and formulations of these which, when present in small quantities in an aggressive medium, inhibit corrosion by bringing about changes in the surface condition of the metal. The commercially available corrosion inhibitors are less friendly to the environment. Increasingly, operating companies, the government and the public have become concerned about toxicity and environment impact of oil field chemicals, especially in offshore. In offshore operations such as in North Sea, environmentally sounds chemicals are very important. To protect marine environment, corrosion inhibitor should be non-toxic to fish, plants and organisms, and should be biodegradable and reasonably water soluble (it is desired that the partition coefficient of octanol and water should be less than three). Furthermore, the flash point of the solvent and the solvent evaporating factor of the chemical are considered in designing these inhibitors.

For this, corrosion inhibitors, the inventive focus has been a corrosion inhibitors, which have low toxicity in a marine environment. The present invention is related to compounds and compositions, which are very effective corrosion inhibitors in oil and gas field applications, and have less impact on the natural environment.

The low toxicity inhibitor of the present disclosure finds application in tropical waters where the temperature remains relatively high around the offshore production platform. Likewise, it can be used in colder waters including the North Sea and elsewhere. These are waters where temperatures get down to freezing, and yet still support different types of marine life. In both instances, the corrosion inhibitor of the present disclosure is a fluid which can be discharged with the salt water and yet have low toxicity for the marine life.

In general terms, the present disclosure sets forth a reaction product, which is obtained by a relatively straight forward reaction and does not involve extreme difficulties in manufacture.

Consider a production situation in which a production stream of oil droplets suspended in salt water is recovered at 185° F. This is not an uncommon circumstance. This stream will be produced up through the production tubing string in the well, and it is then directed through the well head equipment, a set of valves enabling connection to horizontal gathering lines that extend to a separator tank. A separator tank is commonly a tall, relatively thin upstanding cylinder. It is sometimes called a shotgun tank. Depending on the volume, the tank may be 20 to 30 feet in height. Again, depending on the volume, the diameter may be as small as about 3 feet up to some large diameter. With the passage of time, the oil collects on the top surface of accumulated liquid, and the hot salt water collects at the bottom. While it may cool in that interval, and may actually become quite cool dependent on the northern latitude of the tank and the season of the year, the interior of the tank is exposed to strong salt water solutions, often at elevated temperatures. It is necessary to protect against corrosion the production tubing stream, the well head equipment, and everything made of metal which comes into contact with the flowing fluid. While at the first blush it might appear that produced oil is relatively benign, this is far from the situation that normally occurs. Rather, the produced fluid is typically quite corrosive and will react to damage the metal surfaces.

In some instances, an offshore production platform will produce a large quantity of salt water along with the produced oil. The separator tank on the platform is filled substantially with produced salt water. The salt water can be returned to the ocean, or perhaps to an injection well. In some instances, return of this to the ocean is the only practical solution. Where the produced mix of fluids includes a lot of salt water, and the salt water is returned to the ocean, the operator is placed in a pinch by the desirability of returning produced salt water back to the ocean which does not create a pollution risk, and on the other hand, the pinch relates to the need to add corrosion inhibitors. Successful corrosion inhibitors have been provided heretofore which are quite good and are exemplified in the U.S. Pat. Nos. 5,611,991, 5,611,992, and 5,779,938. These inhibitors are quite successful. They are, however, not readily discharged into a ocean or other salt water environment. Effectively, these inhibitors are handicapped by being somewhat toxic to marine life. The present invention set out an inhibitor compound, more accurately, a family of compounds which has reduced toxicity. Effectively, toxic compounds which include fatty amines, fatty poly amines, fatty amides, fatty poly amides, imidazolines and poly imidazolines are all reacted with both acrylic acid and monochloro acetic acid in such a way that the base nitrogen atoms present in these compounds are reacted with acrylic acid and monochloro acetic acid, or their salts. This converts a highly toxic base molecule (being an amine as exemplified above) and yields a product which provides a quality corrosion inhibitor but which is less toxic.

The need for corrosion inhibitors is accelerated when a well produces something other than the expected flowing oil (with out without natural gas). Often, salt water is produced as mentioned. In addition to that in liquid form, added gases are produced which sometimes create problems. These added gases include $CO_2$ and $H_2S$. Small bubbles of these two gases are often entrained in the produced oil at substantial depths, and the bubbles, while not readily apparent at great depths where the pressure reduces bubble size, become something of a problem as the containment pressure is reduced while flowing to the surface. At the surface, what would appear to be a flowing stream of liquid becomes a froth as the dissolved gases come out of solution, thereby exposing the pipe to corrosion. These gases create problems, thereby shortening the life of the metal goods. Effectively, this attacks the production tubing and any other metal exposed to the flow. The flowing produced oil, with or without the above mentioned gases, and with or without bubbles of entrained natural gas, may also occasionally include low molecular weight organic acids. These are exemplified by acids such as acetic, formic and propionic acid. These acids will attack any exposed metal surface.

Inhibitors can be provided that overcome the problems just mentioned which are grouped in three general groups, the problems derived from: 1) produced gases; 2) produced salt water; and 3) produced acids. The concentration or amount of each may vary, but these are especially problematic depending on pH of the flow, temperature, relative concentrations, and the intervals between servicing of the well. For instance, it is necessary to service the well by adding the corrosion inhibitor exemplified by this present disclosure to the flow periodically. Without adding it in the flow, protection is lost.

Moreover, this poses a significant problem in offshore locations where the produced salt water is separated from the valuable products and is ultimately returned to the ocean. This is permitted provided the salt water discharge back into the ocean is nontoxic to the aquatic life in the ocean. The toxicity of the discharge obviously relates to something other than the salt content in the discharge. The ocean itself, being already charged to a specified salt solution, can receive various and sundry types of saltwater discharges from an offshore production platform. However, those discharges pose a problem if they attack the small fishes or other life that normally inhabits such waters. While this may be somewhat dependent on local salinity levels and ambient temperature, the present disclosure sets forth a corrosion inhibitor and a method for making the inhibitor, to provide an inhibitor which can be discharged in the presence of marine life without damage. An example of this will be given including a number of tests using specific, common, marine life.

The low toxicity inhibitor of the present disclosure finds application in tropical waters where the temperature remains relatively high around the offshore production platform. Likewise, it can be used in colder waters including the North Sea and elsewhere. These are waters where the temperatures get down to freezing, and yet still support different types of marine life. In both instances, the corrosion inhibitor of the present disclosure is a fluid which can be discharged with the salt water and yet have low toxicity for the marine life.

In general terms, the present disclosure sets forth a reaction product which is obtained by a relatively simple reaction. As will be detailed, the reactive sequence is relatively straight forward and does not involve extreme difficulties in manufacture. Furthermore, the reactive process permits use of several different feeds within a specified group of feed stocks.

BRIEF SUMMARY OF THE PRESENT DISCLOSURE

This disclosure is directed to the synthesis of the corrosion inhibitor which is effective to protect ferrous metals, and yet which dissolves in produced petroleum streams with or without salt water, and is ultimately soluble in salt water. It has a low toxicity for marine life when discharged into the ocean. This low toxicity level protects marine life in the vicinity of the discharge.

DETAILED DESCRIPTION OF THE PREFERRED EMBODIMENT

The context of present disclosure is protection of metal surfaces exposed to flowing produced oil and gas products beginning with the production well and including the well equipment. This is exemplified the production tubing stream which extends from a production zone, appropriate gas lift valves and well head equipment at the top of the well. This includes the gathering lines which extend from the well head to a tank battery or a separator tank. This also includes the metal surfaces which contact produced fluids and other well head located equipment such as separators, high pressure pumps, and the like. This also extends to the gathering lines and the storage tanks. A common location is on an offshore production platform where the fluids flow from one or more wells into the production equipment and produced salt water is separated and ultimately returning to the ocean. One aspect of the corrosion inhibitor is that it has a very mild, almost benign impact on marine life in the ocean.

The corrosion inhibitor of the present disclosure is a corrosion inhibitor which is added to a flowing production stream. The stream that carries the corrosive material also carries the inhibitor. The inhibitor contacts and coats the metal. The exposed metal, being coated by the flowing stream, prevents subsequent corrosion of the surface by the corrosive agents in the flowing stream. As mentioned in the background above, the flowing stream is typically a flow of produced oil from a well which includes one or more of the typical corrosive agents noted above and including: 1) inorganic salts mixed in water, hence brine; 2) dissolved gases (other than natural gas) which are commonly $CO_2$ or $H_2S$ or both; and 3) dissolved acids exemplified by acetic, formic or propionic acids. These corrosive agents may be present or absent, may be present in dilute or strong concentrations, and may be highly irregular in flow rate. Suffice it to say, when they are typically present, they attack the metal of the production flow path beginning literally with the producing zone and extending up through the production tubing and down stream ultimately to a tank battery for storage.

The present corrosion inhibitor is an amine derivative which is represented by any of the following three formulas:

$$R—X(C_2H_4NZ)_nC_2H_4NZ_2; \quad (1)$$

or $$Z_2N(CH_2)_mNZ_2; \quad (2)$$

or $$R—NZ_2; \quad (3)$$

where

R=C12 to a C36 hydrocarbon or aryl saturated or unsaturated ring;

X=amide (—CO—NH—) or a 5-membered cyclic imidazoline ring;

Z=unsaturated carboxylic acid or halocarboxylic acid, or salts of these compounds;

n=an integer from 1 to 6; and m=an integer from 12 to 36.

One method of manufacture of compounds within the above 20 definition is obtained by reacting at least one mole of unsaturated carboxylic acid with one mole of halocarboxylic acid, preferably monochloro acetic acid or salts thereof.

Common procedures within the above generalized definition include the production of the corrosion inhibitor by reacting alkyl amine, aryl, amine, polyethyl amine with C12 to C36 fatty acid, and subsequently reacting with halocarboxylic acid, preferably monochloro acetic acid (MCAA), and an unsaturated carboxylic acid, preferably acrylic acid (AA) or their salts, in such a way that all reactive hydrogen atoms, attached to the nitrogen atoms, are substituted with a least one molecule of MCAA and one molecule of AA.

Among the amines which are suitable for this invention are: ethylene diamine, ethylene triamine, triethylene, tetramine, aminoethyl, ethanol amine, tetraethylene pentamine, aminoethyl piperazine, cocoamine, cocodiamine, tallow amine, tallow diamine and tallow triamine.

The fatty acid may include: tall oil fatty acid, oleic acid, linoleic acid, coconut acid, tallow acid and naphthenic acid.

EFFECTIVE CORROSION INHIBITOR MEASUREMENTS

A common mode of testing the effectiveness of a corrosion inhibitor involves the use of a rotating cylinder electrode. This standardized test device is used to make measurements which are evaluated using a linear polarization resistance technique (LPR hereinafter) in which a test coupon is monitored for the duration of the test. The test coupon is mounted in the test equipment, and then scans are made from +15 mv to −15 mv versus the open circuit potential. The scan is made at a rate of about 0.5 mv per second using commercially available test equipment with a commercially available software package. The equipment measures and generates the results automatically. The test is carried out in NACE brine (100,000 TDS) which brine is deoxygenated. It is purged continuously with $CO_2$, and the test is carried out at an elevated temperature of 160° F. The electrode is rotated at 3,000 rpm which is equivalent to a fluid velocity of 6 ft/sec (a flow rate common in production tubing strings). Several examples are given below. In the table, the headings for the table include the example number (listed below), the composition of the corrosion inhibitor is listed next, and the data especially tabulates the corrosion rate. The corrosion rate is normally indicated in mills per year, see the column labeled MPY Corrosion. Each test composition is tabulated in table 1 to indicate the molar equivalent of MCAA or AA. In addition, the table shows relative concentrations of the corrosion inhibitor in either of two ranges which are 25 to 50 or 50 to 100 parts/million or ppm and effect on the marine line, discussed below after several examples are given.

TABLE

| | | LPR test results | | | | |
|---|---|---|---|---|---|---|
| Example | Composition | Molar equiv AA | Molar Equiv MCAA | MPY Corrosion | LC-50 25–50 ppm | LC-50 50–100 ppm |
| 1 | Tall oil/DETA imidazoline | 3 | 1 | 0.8 | | >60 |
| 2 | TALL Oil/DETA Imidazoline | 2 | 2 | 1.1 | | >50 |
| 3 | Tall Oil/DETA Imidazoline | 1 | 3 | 0.8 | | >66 |
| 4 | Tall oil/DETA Amide | 3 | 1 | 1.2 | | >55 |
| 5 | Tall Oil/DETA Amide | 2 | 2 | 1.1 | | >60 |
| 6 | Tall Oil/DETA Amide | 1 | 3 | 0.9 | | >50 |
| 7 | Tall Oil/AEP Amide | 1 | 2 | 2.0 | >37 | |
| 8 | Tall Oil/AEP Amide | 2 | 1 | 2.1 | >36 | |

TABLE-continued

| | | LPR test results | | | | |
|---|---|---|---|---|---|---|
| Example | Composition | Molar equiv AA | Molar Equiv MCAA | MPY Corrosion | LC-50 25–50 ppm | LC-50 50–100 ppm |
| 9 | Tall Oil/TEPA Amide | 2 | 2 | 1.6 | >43 | |
| 10 | Tall Oil/TEPA Amide | 3 | 1 | 1.4 | >46 | |
| 11 | Tall Oil/TEPA Amide | 1 | 3 | 2.0 | >44 | |
| 19 | Cocodiamine | 4 | 1 | 5.8 | | >60 |

EXAMPLE 1

In an appropriate container, 290 g comprising 1.0 mole of tall oil was added to 103 g of diethylenetriamine (DETA) which was 1.0 mole. After mixing together, the temperature in the container was increased to 350° F. Vapors from the container were cooled to enable the removal of 18 g (or 1.0 mole) of water. On the removal of 1.0 mole of water, the ingredients had converted to 100% amide. By subsequently increasing the temperature from 350° F. to 480° F., and capturing the vapors, another mole of water was removed. The product then left was imidazoline.

Subsequently, 1.0 mole of imidazoline (about 360 g), the solution obtained from the foregoing steps involving tall oil and DETA, was dissolved in 200 g of propylene glycol. Three moles or 216 g of acrylic acid was added slowly to this mixture and stirred during the addition. Thereafter, a mole of MCAA (94.5 g) was added after cooling to room temperature. Then, the mixture was heated slowly to 200° F. and was maintained for 5 hours. By appropriate monitoring, the reaction was carried to completion. Then, the slightly acidic solution was neutralized to a pH of about 7.0 with a caustic solution. On achieving the neutral condition, the next step was the addition of water to provide a product which was a 40% solution of the active ingredient.

This final product was then tested in accordance with the described procedure to yield data in the Table. Note the desirable results where the corrosion was only 0.8 MPY. Note also that this was accomplished with a solution having 3 molar equivalents of AA and one molar equivalents of MCAA. The Table data shows the respective amounts of AA and MCAA in the final corrosion inhibitor. As will be discussed in some detail below, the amounts of AA and MCAA are sufficient to accomplish what is thought to be the chemistry of this conversion process. That will be discussed below.

EXAMPLE 2

An imidazoline was prepared according to the procedure in Example 1, using 144 g(2.0 moles) of AA and 189 g(2.0 moles) of MCAA.

EXAMPLE 3

An imidazoline was prepared according to the procedure in Example 1, using 72 g (1.0 mole) of acrylic acid and 283.5 g (3.0 moles) of monochloro acetic acid.

EXAMPLE 4

An amide (tall oil and DETA adduct) was prepared according to the procedure in Example 1, using 216 g (3.0 moles) of AA and 94.5 g (1.0 mole) of MCAA.

EXAMPLE 5

An amide was prepared according to the procedure in Example 1, using 144 g (2.0 moles) of AA and 189 g (2.0 moles) of MCAA.

EXAMPLE 6

An amide was prepared according to the procedure in Example 1, using 72 g (1.0 mole) of AA and 283.5 g (3.0 moles) of MCAA.

EXAMPLE 7

Following the procedure outlined for the amide in Example 1, 376 g (1.0 mole) of amide (1/1 tall oil and aminoethylpiperizine adduct) was dissolved in 200 g of propylene glycol. 72 g (1.0 mole) of acrylic acid as added slowly at room temperature, followed by the addition of 189 g (2.0 moles) of MCAA. The mixture was heated to 200° F. for 5 hours, followed by neutralization with a caustic solution and dilution with water to yield a 40% active product.

EXAMPLE 8

An amide was prepared according to the procedure in Example 7, using 144 g (2.0 moles) of acrylic and 94.5 g (1.0 mole) of MCAA.

EXAMPLE 9

Following the procedure outlined for imidazoline in Example 1, 768 g (1.0 mole) of imidazoline (2/1 tall oil and TEPA adduct) was dissolved in 200 g of propylene glycol. 144 g (2.0 moles) of AA was added slowly, followed by 189 g (2.0 moles) of MCAA. The mixture was heated to 200° F. for 4–5 hours, followed by neutralization with a caustic solution and dilution with water to yield a 40% active product.

EXAMPLE 10

An imidazoline was prepared according to the procedure in Example 9, using 216 g (3.0 moles) of acrylic acid and 283.5 g (3.0 moles) of MCAA.

EXAMPLE 11

An imidazoline was prepared according to the procedure in Example 9, using 216 g (3.0 moles) of acrylic acid and 94.5 g (1.0 mole) of MCAA.

EXAMPLE 12

Following the procedure outlined for imidazoline in Example 1, 639 g (1.0 mole) of amido-imidazoline, a reaction product of two moles of tall oil with one mole of DETA was dissolved in 200 g of propylene glycol. 72 g (1.0 mole) of acrylic acid was added, followed by the addition of 94.5 g (1.0 mole) of MCAA.

EXAMPLE 13

An imidazoline was prepared according to the procedure in Example 9, using 144 g (2.0 moles) of acrylic acid and 189 g (2.0 moles) of MCAA.

EXAMPLE 14

373 g of tallow triamine (TTA) was dissolved in 200 g of propylene glycol. 144 g (2.0 moles) of acrylic acid was added slowly to the solution, followed by addition of 472.5 g (5.0 moles)of MCAA at room temperature. The mixture was heated to 200° F. for 5 hours, followed by neutralization with a caustic solution and dilution with water to yield a 40% active product.

EXAMPLE 15

A tallow triamine solution was prepared according to the procedure outlined in Example 14, using 72 g (1.0 mole) of acrylic acid and 567 g (6.0 moles) of MCAA.

EXAMPLE 16

A TTA solution was prepared according to the procedure in Example 14, using 216 g (3.0 moles) of acrylic acid and 378 g (4.0 moles) of MCAA.

EXAMPLE 17

A TTA solution was prepared according to the procedure in Example 14, using 288 g (4.0 moles) of acrylic acid and 283.5 g (3.0 moles) of MCAA.

EXAMPLE 18

A TTA solution was prepared according to the procedure in Example 14, using 360 g (5.0 moles) of acrylic acid and 189 g (2.0 moles) of MCAA.

EXAMPLE 19

A TTA solution was prepared according to the procedure in Example 14, using 432 g (6.0 moles) of acrylic acid and 94.5 g (1.0 mole) MCAA.

EXAMPLE 20

246 g of cocodiamine (CDA) was dissolved in 200 g of propylene glycol. 288 g (4.0 moles) of acrylic acid was added, followed by the addition of 94.5 g (1.0 mole) of MCAA at room temperature. The mixture was heated to 200° F. for 5 hours, followed by neutralization with a caustic solution, and dilution with water to yield a 40% active product.

EXAMPLE 21

A CDA solution was prepared according to the procedure in Example 20, using 216 g (3.0 moles) of acrylic acid and 189 g (2.0 moles) of MCAA.

EXAMPLE 22

A CDA solution was prepared according to the procedure in Example 20, using 144 g (2.0 moles) of acrylic acid and 378.5 g (3.0 moles) of MCAA.

EXAMPLE 23

A CDA solution was prepared according to the procedure in Example 20, using 72 g (1.0 mole) acrylic acid and 478 g (4.0 moles) of MCAA.

EXAMPLE 24

Following the procedure outline for imidazoline in Example 1, 453 g (1.0 mole) of imidazoline (1/1 mole ratio of tall oil and TEPA adduct) was added and dissolved in 200 g of propylene glycol, then 94.5 g (1.0 mole) of MCAA was added and followed with 432 g (6.0 moles) of acrylic acid at room temperature. The mixture was heated to 200° F. for 5 hours, followed by neutralization with caustic solution and dilution with water to yield 40% active product.

EXAMPLE 25

An imidazoline was prepared according to the procedure outline in Example 24, using 189 g (2.0 moles) of MCAA and 360 g (5.0 moles) acrylic acid.

EXAMPLE 26

An imidazoline was prepared according to the procedure outline in Example 24, using 283.5 g (3.0 moles) MCAA and 288 g (4.0 moles) of acrylic acid.

EXAMPLE 27

An imidazoline was prepared according to the procedure outline in Example 24, using 378 g (4.0 moles) MCAA and 216 g (3.0 moles) acrylic acid.

EXAMPLE 28

An imidazoline was prepared according to the procedure outline in Example 24, using 472.5 g (5.0 moles) MCAA and 144 g (2.0 moles) acrylic acid.

EXAMPLE 29

An imidazoline was prepared according to the procedure outline in Example 24, using 567 g (6.0 moles) MCAA and 72 g (1.0 mole) acrylic acid.

EXAMPLE 30

Following the procedure outline for amide or imidazoline in Example 1, 405 g (1.0 mole) of imidazoline (1 to 1 mole ratio of tall oil and triethylenetetramine "TETA" adduct) was dissolved in 200 g of propylene glycol then 72 g (1.0 mole) of acrylic acid was added slowly, followed by 567.5 g (6.0 moles) of MCAA at room temperature. The mixture was heated to 200° F. for 5 hours, followed by neutralization with caustic solution, and dilution with water to yield 40% active product.

EXAMPLE 31

An amide or imidazoline was prepared according to the procedure in Example 30, using 72 g (1.0 mole) acrylic acid and 567 g (6.0 moles) of MCAA.

EXAMPLE 32

An amide or imidazoline was prepared according to the procedure in Example 30, using 144 g (2.0 moles) acrylic acid and 472.5 g (5.0 moles) of MCAA.

EXAMPLE 33

An amide or imidazoline was prepared according to the procedure in Example 30, using 216 g (3.0 moles) acrylic acid and 378 g (4.0 moles) of MCAA.

EXAMPLE 34

An amide or imidazoline was prepared according to the procedure in Example 30, using 288 g (4.0 moles) acrylic acid and 283.5 g (3.0 moles) of MCAA.

EXAMPLE 35

An amide or imidazoline was prepared according to the procedure in Example 30, using 360 g (5.0 moles) acrylic acid and 189 g (2.0 moles) of MCAA.

EXAMPLE 36

An amide or imidazoline was prepared according to the procedure in Example 30, using 432 g (6 moles) acrylic acid and 94.5 g (1.0 mole) of MCAA.

Testing for Marine Toxicity

Toxicity testing was carried out using the guidelines found at: "Methods for Measuring the Acute Toxicity of Effluents and Receiving Waters to Freshwater and Marine Organisms", 4th Ed. (EPA/600/4-90/027). The species chosen for this test procedure was Mysidopsis Bahia, which is an estuarine, shrimp-like crustacean common in many oceans of the world. As described more specifically in the test protocol noted, the test involved 48 hours. exposure of a specified number of juvenile organisms (the one chosen above) to various concentrations of the test solution and synthetic sea water. By testing over 48 hours exposure of a specified number of juvenile organisms of the above-identified species, with various concentrations, with daily monitoring of survival, measurement of the pH, measurement of dissolved oxygen, salinity and temperature, the test data shown in the Table was obtained as listed in the last two columns. An acceptable goal for low toxicity is met if the population of organisms survived at a rate of 90% or more at the end of the 48 hour interval. In the Table, the concentration of the corrosion inhibitor is expressed in ppm and survival rates are given as a percentage of the population after 48 hours.

The corrosion inhibitor of the present disclosure is made and shipped in containers for delivery into an injection device. It is trickled or dribbled into a flowing system. For instance, it can be input to a gas lift system by placing it in the gas which is delivered down a tubing string for delivery into the gas lift valves. In another example, it can be injected at the well head. In another example, it can be input to a production tubing string from the bottom of a producing formation by compressing a container of it and administering it through a control flow needle valve. In another example, it can be added to a gathering line before the gathering line flows into the gathering tanks, separator tank, and so on. In all these instances, it can be input so that the corrosion inhibitor is readily available for incorporation with the flowing fluid.

Considering this further, the corrosion inhibitor can be delivered as manufactured or can be mixed with some kind of diluting carrier or base. The carrier can be any petrochemical solvent. A less costly solvent is more desirable. Also, it can be mixed with a water based solution.

When added to the flowing fluid, it is delivered at a rate so that a coating is achieved on the metal surfaces that are exposed to the flowing fluid with or without gas and with or without any particular type of laminar or irregular flow.

The flowing fluid is transmitted through the flow lines with the inhibitor in the fluid. Contact is made so that a surface coating is built up. If injected continuously, the coating of the metal surfaces is renewed routinely. A suitable flow rate is determined for a given situation and can be increased or decreased as appropriate. The flow rate can also be intermediance so that corrosion material on the surface is renewed on a daily, weekly, or monthly basis as appropriate.

While the foregoing is directed to preferred embodiment, the scope thereof is determined by the claims which follow:

What is claimed is:

1. A method of inhibiting corrosion of metal process equipment in a oil field corrosive environment comprising the step of introducing a corrosion inhibiting mixture in an effective amount and consisting essentially of the reaction product of alkyl amine, aryl amine, or polyethyl amine with a fatty acid and subsequently reacted with halocarboxylic acid and an unsaturated carboxylic acid or salts thereof to obtain substitution of substantially all reactive hydrogen atoms attached to a nitrogen atom.

2. The method of claim 1 further comprising the step of maintaining an effective concentration of the corrosion inhibiting mixture or preventing corrosion of metal of the metal process equipment.

3. The method of claim 2 wherein the metal is a ferrous metal.

4. The method of claim 1 wherein the effective amount is somewhere between about 1 ppm to about 500 ppm introduced into the corrosive environment.

5. The method of claim 4 wherein about 2 ppm to about 100 ppm corrosion inhibiting mixture is introduced into the corrosive environment.

6. The method of claim 1 wherein the halocarboxylic acid is monochloro acetic acid, and the unsaturated carboxylic acid is acrylic acid.

7. The method of claim 1 wherein the fatty acid is a hydrocarbon having between 12 and 36 carbons.

8. The method of claim 1 wherein the amine is mixed with the fatty acid and heated to thereafter remove water to obtain amide.

9. The method of claim 8 wherein amide is further heated to obtain imidazoline.

10. A low toxicity corrosion inhibitor which is provided by any of the following formulas or mixtures thereof and comprising:

$$R—X(C_2H_4NZ)_nC_2H_4NZ_2; \quad (a)$$

or $$Z_2N(CH_2)_mNZ_2; \quad (b)$$

or $$R—NZ_2; \quad (c)$$

where (i) R=C18 to a C36 hydrocarbon or aryl saturated or unsaturated ring;

(ii) X=amide (—CO—NH—) or a 5-membered cyclic imidazoline ring;

(iii) Z=salts of unsaturated carboxylic acid and halocarboxylic acid;

(iv) n=an integer from 1 to 6; and (v) m=an integer from 18 to 36.

11. The corrosion inhibitor of claim 10 in a desired concentration in a neutral solvent, and wherein the corrosion inhibitor is adapted to be injected into a flowing stream of oil well production fluids.

12. A low toxicity composition for inhibiting metal corrosion exposed to flowing oil field fluids when the composition comprises a reaction product of a selected amine with a C18 to C36 fatty acid and subsequently reacted to convert any reactive hydrogen atoms attached to nitrogen atoms therein resulting in a low toxicity corrosion inhibitor having reduced reactive hydrogen atoms.

13. A method of making a corrosion inhibitor comprising the steps of:

(a) forming a reaction product of alkyl amine, aryl amine, polyethyl amine or mixtures thereof with a fatty acid; and (b) subsequently reacting the product of step (a) with a halocarboxylic acid and a carboxylic acid or salts thereof to obtain substitution of substantially all reactive hydrogen atoms attached to nitrogen atoms, thereby obtaining a reduced toxicity corrosion inhibitor.

14. The method of claim 13 wherein the inhibitor comprises an imidozoline.

15. The method of claim 13 wherein the halocarboxylic acid is monochloro acetic acid, and the carboxylic acid is acrylic acid.

16. The method of claim 15 wherein one mole of the reaction product of step (a) is reacted with one mole of acrylic acid and three moles of monochloro acetic acid.

17. The method of claim 13 wherein the reaction product of step (a) is further heated to produce amide, which is subsequently reacted with two moles of acrylic acid and two moles of monochloro acetic acid.

18. The method of claim 13 wherein the reaction product of step (a) is further heated to produce amide, which is subsequently reacted with one mole of acrylic acid and three moles of monochloro acetic acid.

19. The method of claim 13 wherein the reaction product of step (a) is further heated to produce amide, one mole of which is dissolved in propylene glycol and added with one mole of acrylic acid at room temperature, followed by the addition of two moles of monochloro acetic acid and then heated.

20. The method of claim 13 wherein the reaction product of step (a) is first heated to produce amide, which is further heated to produce imidazoline, one mole of which is dissolved in propylene glycol and added with two moles of acrylic acid at room temperature, followed by the addition of two moles of monochloro acetic acid.

21. The method of claim 20 wherein the fatty acid is tall oil and the amine is tetraethylene pentamine adduct.

22. The method of claim 13 wherein the amine is diethylenetriamine and the fatty acid is tall oil, wherein two moles of tall oil is reacted with one mole of diethylenetriamine to produce amido-imidazoline, which is dissolved in propylene glycol and mixed with one mole of acrylic acid and one mole of monochloro acetic acid.

23. The method of claim 13 wherein the amine is tallow triamine, one mole of which is dissolved in propylene glycol and added with two moles of acrylic acid, followed by the addition of five moles of monochloro acetic acid and then heated.

24. The method of claim 13 wherein the amine is cocodiamine, one mole of which is dissolved in propylene glycol and added with acrylic acid, followed by the addition of one mole of monochloro acetic acid at room temperature.

* * * * *